United States Patent [19]

Kalvåg

[11] Patent Number: 4,722,329

[45] Date of Patent: Feb. 2, 1988

[54] APPARATUS FOR THE TREATMENT OF PATIENTS WITH LUMBAR BACK AILMENTS OR THE LIKE IN A WATER ENVIRONMENT

[76] Inventor: John B. Kalvåg, N-2600 Lillehammer, Ekromskogen 4d, Norway

[21] Appl. No.: 709,176

[22] Filed: Mar. 7, 1985

[30] Foreign Application Priority Data

Mar. 22, 1984 [NO] Norway ..... 841128

[51] Int. Cl.[4] ..... A61H 1/02

[52] U.S. Cl. ..... 128/75; 272/71; 441/129

[58] Field of Search ..... 128/75, 66; 272/71; 441/129, 114, 115

[56] References Cited

U.S. PATENT DOCUMENTS

| | | | |
|---|---|---|---|
| 1,752,630 | 4/1930 | Brown | 272/71 |
| 3,179,963 | 4/1965 | Peterson | 441/115 |
| 4,396,012 | 8/1983 | Cobiski | 128/75 |
| 4,422,452 | 12/1983 | Burton | 128/75 |
| 4,524,763 | 6/1985 | Eberling | 128/75 |
| 4,551,108 | 11/1985 | Bass | 441/136 |
| 4,552,540 | 11/1985 | Bass | 441/129 |
| 4,569,340 | 2/1986 | Burton | 128/75 |

*Primary Examiner*—John J. Wilson
*Attorney, Agent, or Firm*—Ladas & Parry

[57] ABSTRACT

An apparatus for the treatment of patients suffering from lumbar back ailments or the like comprises at least one float body suspended from an overhead support, intended for suspending the patient who is partially submersed in water and subjected to loading from weights, preferably at the hip region. The overhead support consists of a suspension means from which, by means of straps, a vest is suspended, adapted to fit closely about the chest region of the patient and thereby supporting the patient. The straps are attached to the overhead support via a yoke or crossbar having a central, vertical journal that is pivotally mounted at the top of the overhead support.

The float body may consist of two elongated, substantially boat-shaped floats, and the overhead support may consist of four downwardly-depending legs attached at the lower ends thereof to the floats and rigidly attached at the upper ends thereof to a top piece which is disposed centrally between the floats and from which the crossbar is supported.

3 Claims, 3 Drawing Figures

APPARATUS FOR THE TREATMENT OF PATIENTS WITH LUMBAR BACK AILMENTS OR THE LIKE IN A WATER ENVIRONMENT

The present invention relates to an apparatus for the treatment of patients with lumbar back ailments or the like, comprising at least one float body with suspension means for supporting the patient who is partially submersed in water and has weights attached to his body, preferably in the hip region.

U.S. Pat. No. 4,396,012 discloses an apparatus for this purpose comprising a vest which is fastened around the patient's torso and is suspended by means of straps from a support means above a swimming pool or the like. The patient is partially submersed in the water and is supported by this device. The vest is composed of at least two separate pieces and is formed such that it basically supports the patient under the armpits.

A device utilised in Germany consists of an annular float body with curved supports attached to the top of the float, intended for supporting a patient who is partially submersed in water in a pool and supported under the armpits by means of the curved supports.

Both of these prior art devices subject the patient's armpits to relatively high pressure loads. In addition, they substantially hinder the naturally depending position and freedom of movement of the patient's arms, and require that the muscles in the arms, body and legs must work relatively strenuously to maintain balance. This is counterproductive for relaxing muscles and joints, including those in the shoulder and neck regions.

The object of the present invention is to improve devices of this type, so that the patient using the apparatus is not subjected to pressure loads under the armpits and his arm, body and leg muscles do not have to work strenuously to maintain balance. As a result, the patient can relax his muscles and joints, even in the shoulder and neck regions.

This is obtained according to the invention with an apparatus of the type generally defined above, which is characterized in that the suspension means consists of an overhead support from which, in a manner known per se, the patient is suspended by means of straps fastened to a vest which is adapted to fit closely about the chest region of the patient's body, thereby supporting the patient.

In a further development of the invention, the straps are attached to the overhead support via a yoke having a central, vertical journal which is pivotally fastened to the top piece of the overhead support. A broad band whose height is adjustable is fastened between the two rear straps depending from the yoke, said band being provided for supporting the patient's head.

A further feature of the invention is that the float body consists of two elongated, substantially boat-shaped floats, and that the overhead support consists of four legs attached at one end to the floats and rigidly attached at the other ends to a top piece which supports the yoke and is centrally disposed between the floats.

A preferred embodiment of the invention is characterized in that the vest has such large armholes that the patient's armpits will not be subjected to pressure loads. To obtain the desired close fit of the vest about the person's torso, the vest is inflatable or has inflatable portions.

The invention will be described in greater detail in the following with reference to the accompanying drawings, which show a practical embodiment of the invention.

Figure 1:
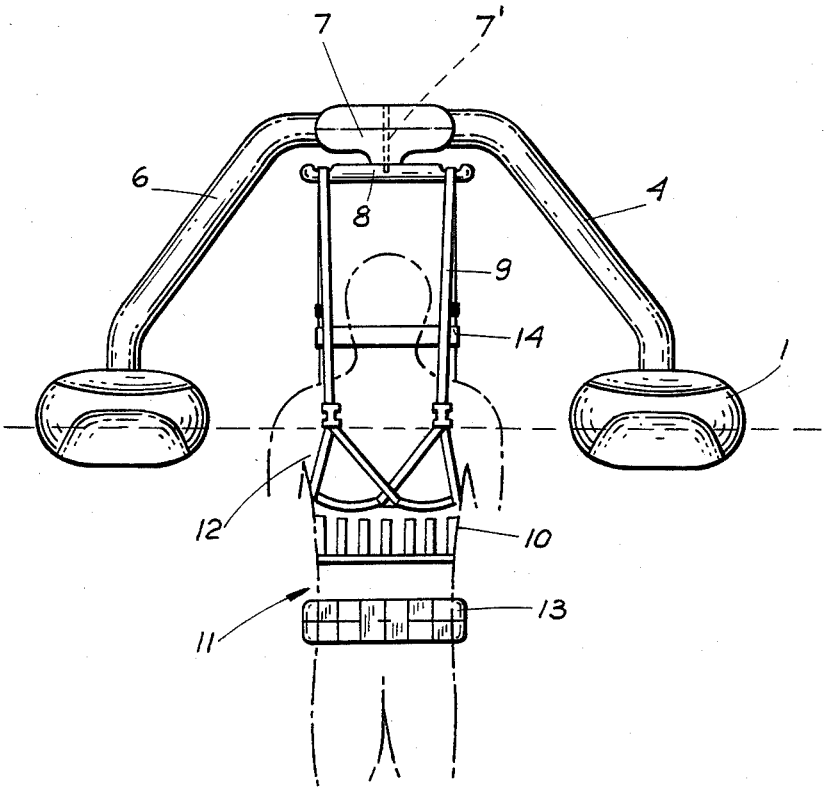
FIG. 1 shows the apparatus of the invention in front view, in use by a patient.
Figure 2:
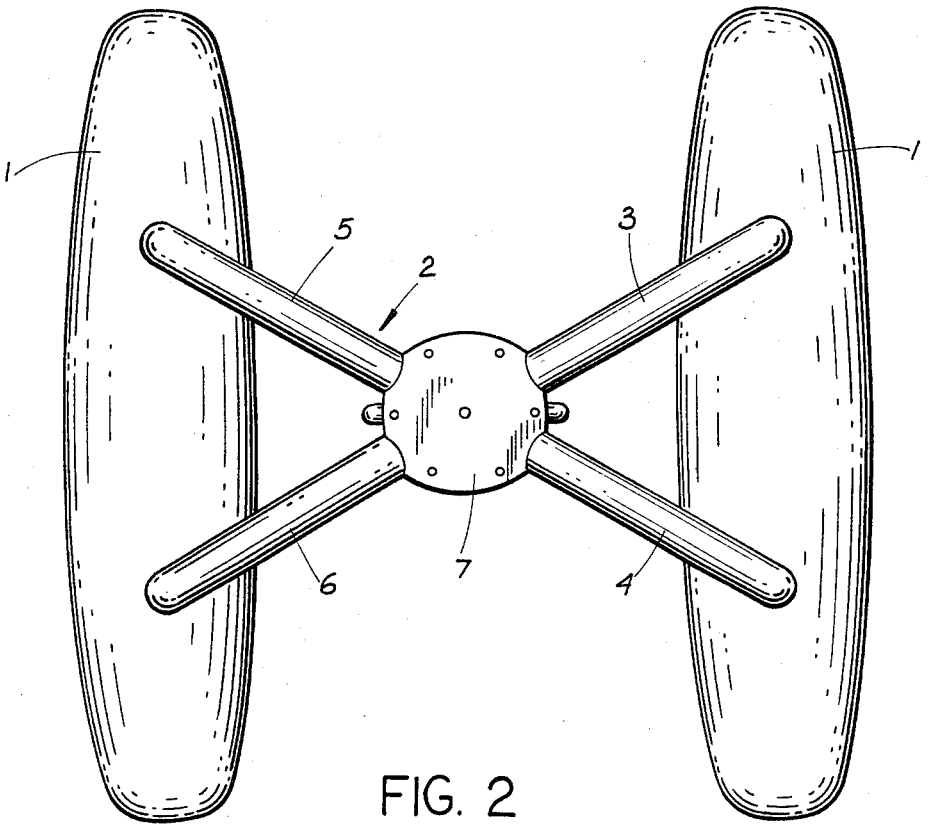
FIG. 2 shows the apparatus as seen from the top.
Figure 3:
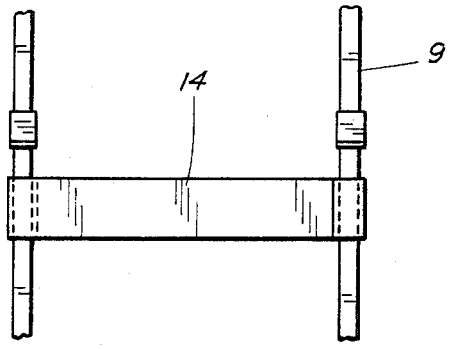
FIG. 3 shows the neck support for supporting the patient's head.

The apparatus consists of two elongated floats 1, which are parallel but spaced apart from each other. Attached to the floats 1 is an overhead support means generally designated by the numeral 2, which consists of four downwardly depending bars or legs 3,4,5,6. The lower ends of the legs are attached to the floats 1, while the upper ends are attached to a central support or top piece 7, so that the four bars together form an "X". A journal 7' is rotatably mounted in the central support 7, and the lower end of the journal is attached to a yoke or cross bar 8. Straps 9 are attached to the ends of the crossbar, and the lower ends of the straps are fastened to a vest 10. The vest is intended to fit closely about the torso 11 of the patient, and it has spacious armholes 12 so that the vest will not press against the armpits of the user. A broad band can be fastened between the two rear straps for supporting the patient's head. The height of the band is adjustable. To apply traction to the spinal column and to keep the patient partially submersed in the water of the pool, a weight belt 13 is attached to the patient's body in the hip region.

By means of this device, a patient perhaps suffering from a lumbar back ailment can be treated while submersed in a pool containing water heated to a suitable temperature. By means of the weight belt 13, the desired tension can be applied to the small of the back. The patient can move freely in the water and propel the device forwardly on the surface of the water, and the patient can also rotate freely in the water owing to the rotatable swivel or journal 7. By resting his head against the support band 14, the patient may relax his neck muscles. The device will promote both physical and psychological well-being, as the patient is free to use his muscles without being subjected to uncomfortable loads. Various types of treatment may be carried out while the patient is suspended in the device. The patient will also feel free and unencumbered, because he can freely swivel around and propel himself through the water.

Having described my invention, I claim:

1. An apparatus for the treatment of persons suffering from lumbar back ailments or the like, comprising two spaced elongated floats, said floats parallel to each other, suspension means for supporting a person partially submerged in water and subjected to weight loading, said suspension means comprised of an overhead support from which the user is suspended by means of straps fastened, at their lower end, to an inflatable vest, said overhead means having four downward depending legs, the lower ends of the said legs attached to said floats, the upper ends of said legs attached to a central support piece, said vest adapted to fit closely about the chest region of the user's body and having oversized arm holes thereby preventing the vest from pressing against a user's armpits, said straps attached to the overhead support by a yoke having a central, vertical journal which is pivotally fastened to the overhead support.

2. An apparatus as defined in claim 1 and a height adjustable band fastened between two of said straps depending from the yoke, said band supporting the user's head and neck.

3. An apparatus as defined in claim 1 wherein the yoke is a crossbar having a central, vertical journal which is rotatably mounted in a top member of the overhead support.

* * * * *